US005188251A

United States Patent [19]

Kusz

[11] Patent Number: 5,188,251

[45] Date of Patent: Feb. 23, 1993

[54] CHILD RESISTANT REMINDER CLOSURE

[75] Inventor: Maximillian Kusz, Waterville, Ohio

[73] Assignee: Owens-Illinois Closure Inc., Toledo, Ohio

[21] Appl. No.: 907,954

[22] Filed: Jul. 2, 1992

Related U.S. Application Data

[63] Continuation-in-part of Ser. No. 878,647, May 5, 1992.

[51] Int. Cl.[5] ..... B65D 55/02

[52] U.S. Cl. ..... 215/220; 215/230; 206/534; 116/308

[58] Field of Search ..... 215/220, 230; 116/308; 206/534

[56] References Cited

U.S. PATENT DOCUMENTS

| | | | |
|---|---|---|---|
| 3,151,599 | 10/1964 | Livingston | 116/308 |
| 4,011,829 | 3/1977 | Wachsmann et al. | 206/534 X |
| 4,220,247 | 9/1980 | Kramer | 116/308 X |
| 4,365,722 | 12/1982 | Kramer | 215/220 |
| 4,749,093 | 6/1988 | Trick | 215/220 |
| 5,009,338 | 4/1991 | Barker | 215/230 |

*Primary Examiner*—Allan N. Shoap
*Assistant Examiner*—Nova Stucker

[57] ABSTRACT

A child resistant reminder closure comprising an outer closure member having a base wall and a peripheral skirt, an inner closure member having a base wall and a peripheral skirt with a bead on the outer closure member retaining the inner closure member for limited axial outward movement relative to the outer closure member. An indicator or a day disk is provided on the outer surface of the inner closure member and is rotatable relative to the outer and inner closure members. A first set of flexible radial ratcheting fingers extend radially from the indicator disk and engage radial lugs on the undersurface of the base wall of the outer closure member. A second set of flexible radial ratcheting fingers extend radially from the indicator disk and engage circumferentially spaced lugs on the upper surface of the inner closure member. Axially interengageable lugs are provided on the outer closure member and the inner closure member which are interengaged to remove the closure or to apply the closure to a container thereby providing a child resistant function. A window in the outer closure member is associated with indicia on the day disk to indicate the circumferential position of the outer closure member relative to the day disk.

12 Claims, 6 Drawing Sheets

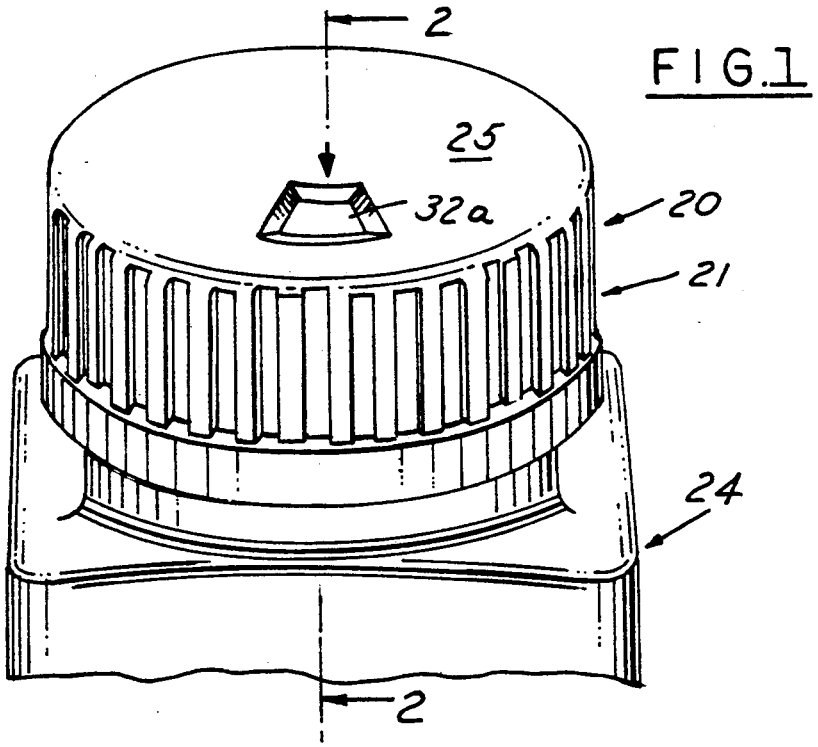
FIG. 1
FIG. 2
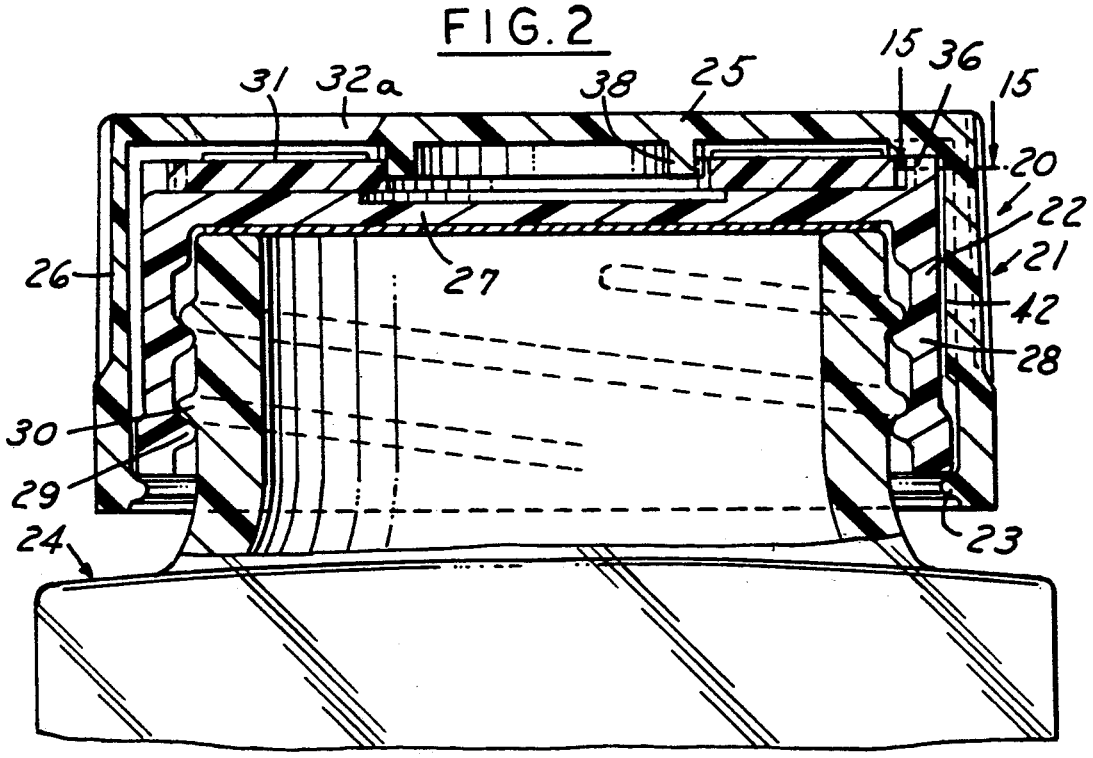

CHILD RESISTANT REMINDER CLOSURE

This application is a continuation-in-part of application Ser. No. 07/878,647 filed May 5, 1992.

BACKGROUND AND SUMMARY OF THE INVENTION

Regular use or maintenance of prescription drugs has become important in ensuring the health of users thereof and is being stressed and advocated by health authorities and governmental agencies such as the United States Food and Drug Administration. To comply with a regimen, it is helpful to remember when the person taking the medication last took the medication. One way of helping in this regard is to have a closure with a visual indicator of when the closure package was last closed or when the package should be opened next.

Current compliance closures use expensive battery operated indicators. Other use mechanical constructions that are complex and costly.

Typical closures of the mechanical type are shown in U.S. Pat. Nos. 3,151,599, 4,011,829, 4,365,722 and 5,009,338. Such closures have the disadvantage that they require axial movement between the reminder components. The axial movement between an outer closure member and an inner closure member of a child resistant closure would not permit such normal axial movement between the components of such reminder closures. In addition, relative axial movement and rotation between the reminder components can cause wear and obliteration of the indicia.

In accordance with the invention shown and claimed in the aforementioned application, a child resistant reminder closure comprises an outer closure member having a base wall and a peripheral skirt, an inner closure member having a base wall and a peripheral skirt with a bead on the outer closure member the inner closure member for limited axial outward movement relative to the outer closure member. An assembly of a day disk and an indexing disk is provided on the outer closure member and is rotatable relative thereto. The day disk is provided adjacent the inner surface of the base wall of the outer closure member and is mounted on the underlying indexing disk. A first set of flexible radial ratcheting fingers extend radially from the day disk and engage radial lugs on the undersurface of the base wall of the outer closure member. A second set of flexible radial ratcheting fingers extend radially from the day disk and engage circumferentially spaced lugs on the surface of the base wall of the inner closure member. Axially interengageable lugs and recesses are provided on the outer closure member and inner closure member which are adapted to be engaged to remove or apply the closure from a container thereby providing a child resistant feature. A window is provided on the outer closure member and is associated with indicia on the day disk to indicate the circumferential position of the outer closure member relative to the day disk.

Such a child resistant reminder closure of the mechanical type is reliable; functions to repeatedly provide the desired information; does not incorporate axial forces between the reminder components; utilizes old and well known child resistant construction; and can be manufactured readily in high-production.

Among the objectives of the present invention are to provide a child resistant reminder closure that has the advantages of the above described child resistant closure and only utilizes three parts; which utilizes the child resistant mechanism in the performance of the indexing function; which is resistant to indexing more than one position; and which can be readily modified to be non-child resistant.

In accordance with the invention, the child resistant closure comprising an outer closure member having a base wall and a peripheral skirt, an inner closure member having a base wall and a peripheral skirt with a bead on the outer closure member retaining the inner closure member for limited axial outward movement relative to the outer closure member. A indicator or a day disk is provided in the outer surface of the inner closure member and is rotatable relative to the outer and inner closure members. A first set of flexible radial ratcheting fingers extend radially from the day disk and engage radial lugs on the undersurface of the base wall of the outer closure member. A second set of flexible radial ratcheting fingers extend radially from the day disk and engage circumferentially spaced lugs on the upper surface of the inner closure member. Axially interengageable lugs are provided on the outer closure member and the inner closure member which are interengaged to remove the closure or to apply the closure to a container thereby providing a child resistant feature. A window is provided on the outer closure member and is associated with indicia on the indicator disk to indicate the circumferential position of the outer closure member relative to the indicator disk.

More specifically, the closure includes A series of axial abutments equally spaced on the circumference of the inner closure skirt. One or more axial abutments are located on the interior of the skirt of the outer closure member. These abutments contact each other when the outer closure member is rotated in the clockwise (application) direction to transmit rotation and/or torque from the outer closure member to the inner closure member. The interengaging lugs on the top panel of the inner and outer closures also perform this function if they are moved into axial engagement.

These abutments on the skirt of the inner closure member ratchet past the abutments on the outer closure member when the outer closure member is rotated in the counterclockwise (removal) direction. The purpose of these abutments is to prevent someone from moving the inner and outer closure members axially apart, and rotating the outer closure member in a clockwise direction to any indexing position.

DESCRIPTION OF THE DRAWINGS

FIG. 1 is a fragmentary perspective view of a child resistant package with a child resistant closure.

FIG. 2 is a part sectional view on a greatly enlarged scale taken along the line 2—2 in FIG. 1.

DESCRIPTION

Figure 3:
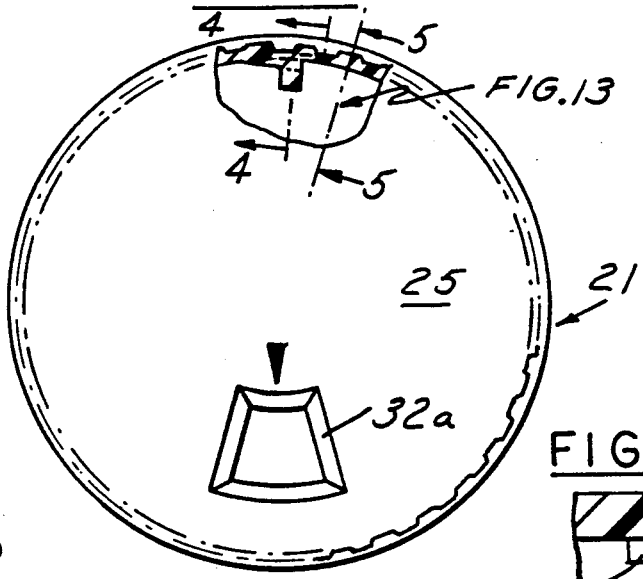
FIG. 3 is a part sectional plan view of the outer closure member of a child resistant closure embodying the invention.
Figure 4:
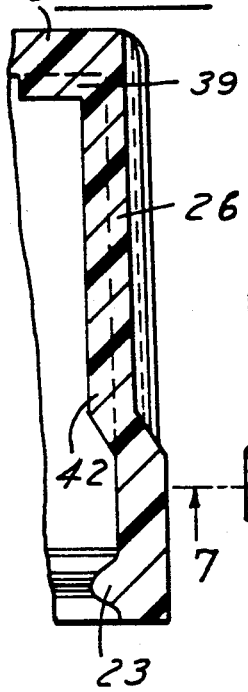
FIG. 4 is a fragmentary sectional view on an enlarged scale taken along the line 4—4 in FIG. 3.
Figure 5:
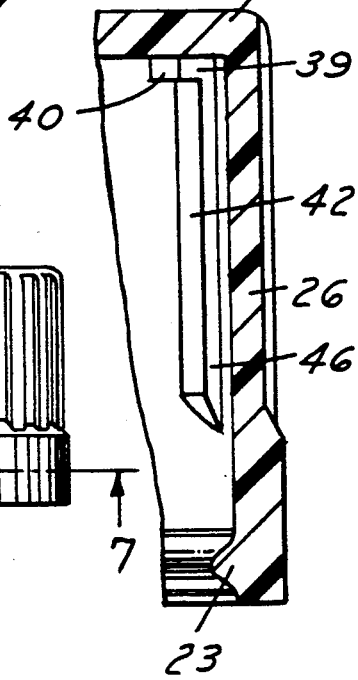
FIG. 5 is a fragmentary sectional view on an enlarged scale taken along the line 5—5 in FIG. 3.
Figure 6:
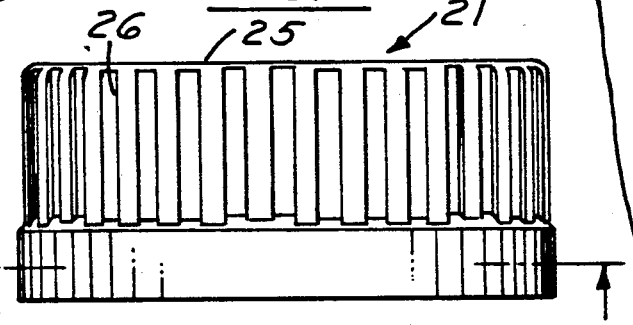
FIG. 6 is a side elevational view on an enlarged scale of the outer closure member.
Figure 7:
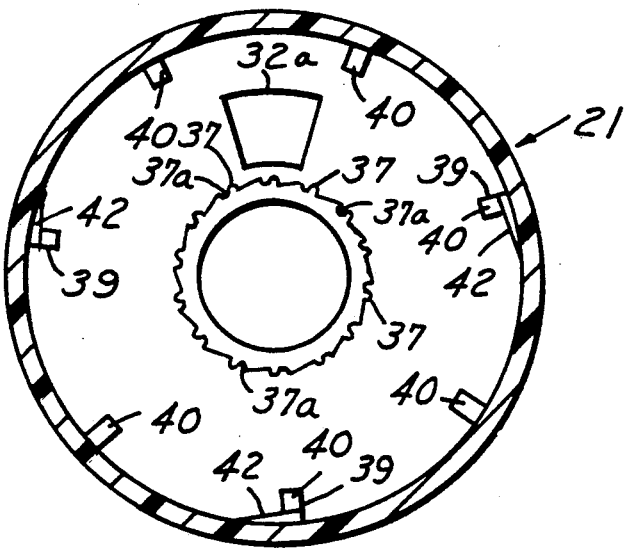
FIG. 7 is a sectional view taken along the line 7—7 in FIG. 6.
Figure 8:
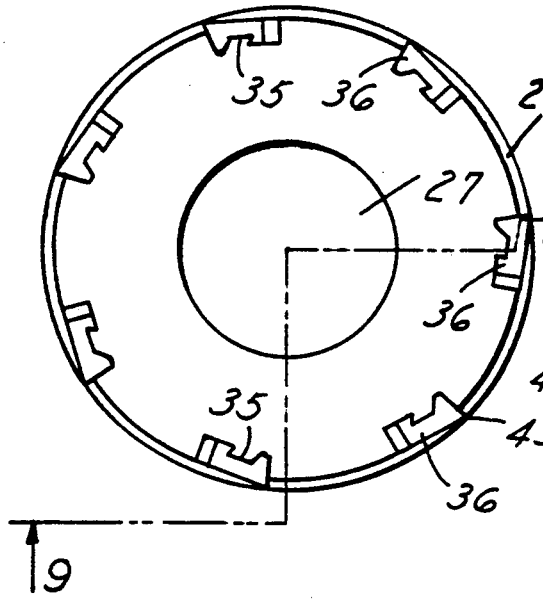
FIG. 8 is a plan view of the inner closure member of the child resistant reminder closure.
Figure 9:
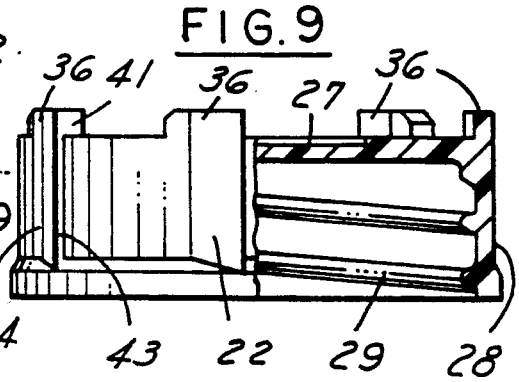
FIG. 9 is a sectional view taken along the line 9—9 in FIG. 8.

Referring to FIGS. 1 and 2, in accordance with invention, the child resistant reminder closure 20 comprises an outer closure member 21 and an inner closure member 22 retained against limited axially outer movement by an annular bead 23. The closure 20 is adapted to be used with a container 24 having threads adapted to be engaged with the threads 29 on the closure 20 is presently described.

The outer closure member 21 comprises a base wall 25 and a peripheral skirt 26. The inner closure member 22 is of a conventional child resistant construction as presently described and includes a base wall 27 and a peripheral skirt 28 having internal threads 29 that are adapted to engage threads 30 on the neck of the container 24. (FIG. 2). An indicator disk 31 is provided on the outer surface of the base wall 27.

Upon clockwise rotation of the outer closure member 21 combined with axial movement of the outer closure member 21 toward the inner closure member 22, the closure 20 is threaded onto the container 24. During this rotation, the outer closure member 21 ratchets past the day disk 31 bringing the succeeding indicia into view through an opening or window 32 in the base wall of the outer closure member 21, as presently described.

Figure 10:
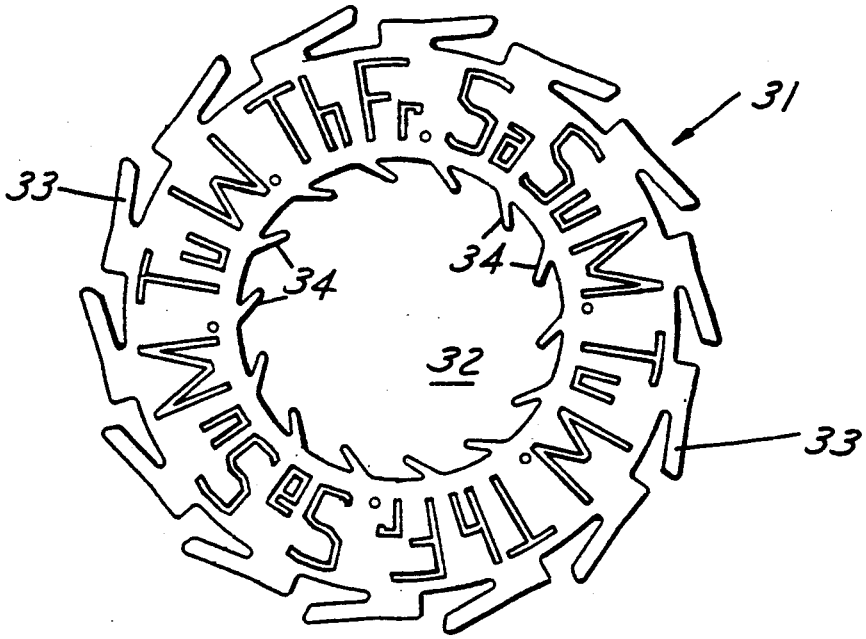
FIG. 10 is a plan view of the indicator or day disk.
Figure 11:
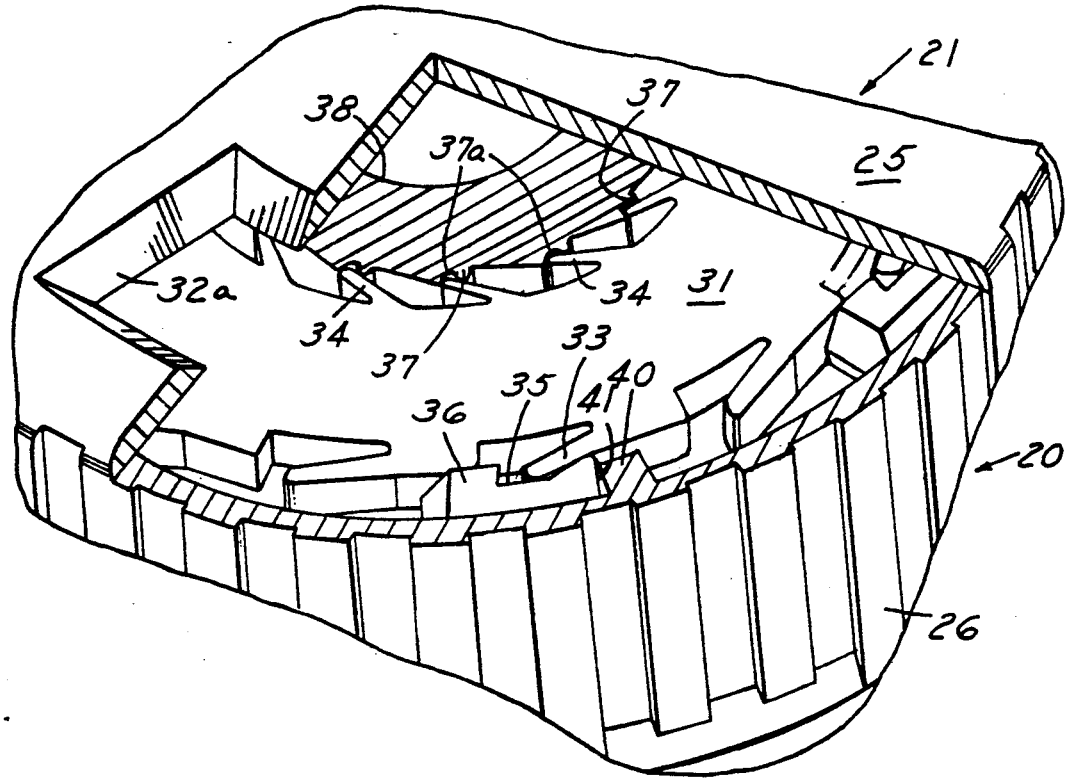
FIG. 11 is a fragmentary part sectional perspective view of the child resistant reminder closure.
Figure 12:
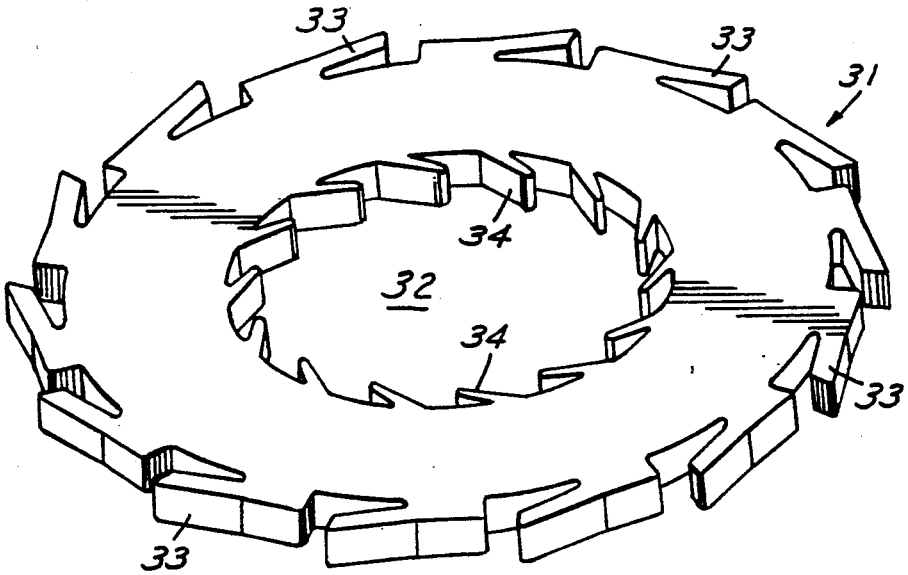
FIG. 12 is a perspective view of the day disk.
Figure 13:
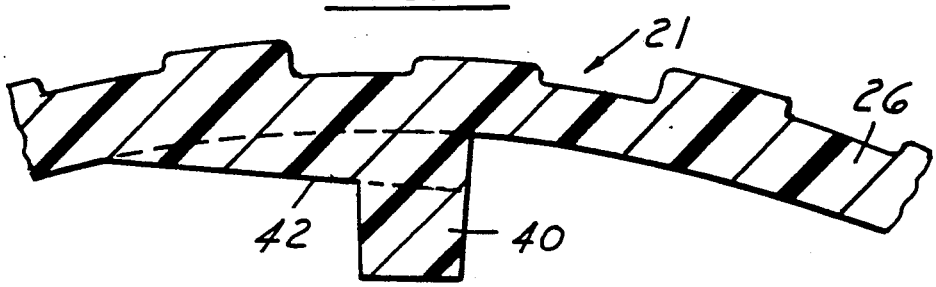
FIG. 13 is a sectional view on an enlarged scale taken at 13 in FIG. 3.
Figure 15:
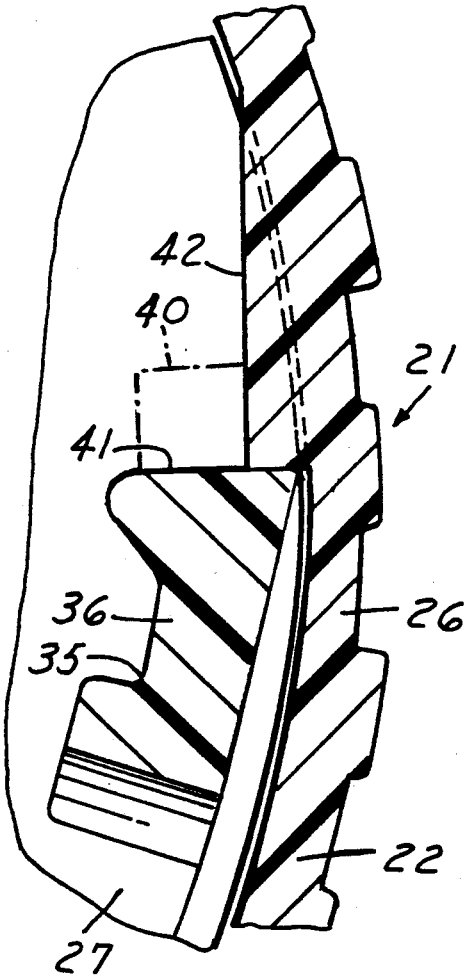
FIG. 15 is a sectional view on an enlarged scale taken along the line 15—15 in FIG. 2.
Figure 14:
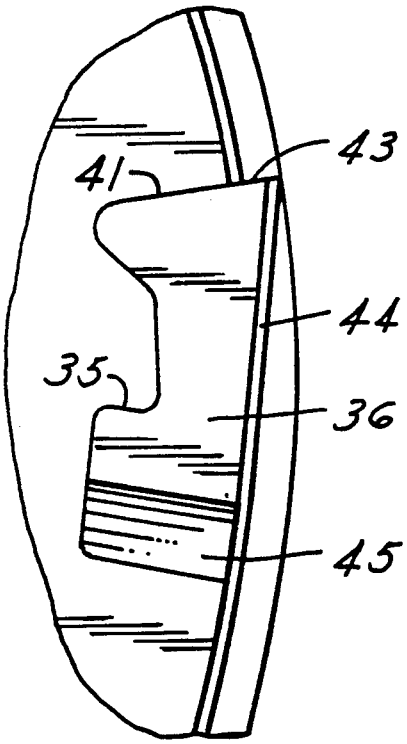
FIG. 14 is a plan view on an enlarged scale of a portion of the top wall of the inner closure member.

As shown in FIGS. 10 and 12, the indicator disk 31 has an opening 32. A plurality of equally spaced flexible ratcheting fingers 33 are provided on the outer periphery thereof that radially extend clockwise as viewed in FIG. 10 and a plurality of equally spaced and ratcheting flexible fingers 34 on the inner periphery of the opening 32 therein which extend radially circumferentially in the same direction as fingers 33. Fingers 33 are adapted to move into recesses 35 on lugs 36 extending axially from the upper surface of the base wall 27 of the inner closure member 22. The flexible fingers 34 are adapted to engage axially extending radial ribs 37 on an annular wall 38 that is integral with and extends from the underside of the base wall 25 of the outer closure member 21 (FIG. 11). The ribs 37 preferably include an axial recess which functions to hold the free edge of a respective finger 34 of the indicator disk 31 in rotational relation to the outer closure member 21.

The various components of the child resistant reminder closure are preferably made of thermoplastic material. The outer closure member 21 and inner closure member 22 are preferably made of polypropylene. The indicator disk 31 is preferably made of high density polyethylene.

The child resistant portion of the closure operates in a similar fashion to the closure described in U.S. Pat. No. 4,997,096. In the unscrewing direction, lugs 40 on the base wall of the outer closure member 21 contact the chamfered side 45 of lugs 35 on the base wall 27 of the inner closure member 22. If sufficient removal torque is applied and downward force is sufficient to prevent the outer closure member 21 from camming over the chamfered lugs 36, the closure 20 will be removed from the container.

When the outer closure member 21 is rotated in a clockwise direction on application, inhibiting means comprising; the sides 39 of the lugs 40 on the outer closure member 21 contacting sides 41 of the lugs 36 on the inner closure member 22 and complementary sides 46 of saw tooth like projections 42 on the inside of the skirt 26 of the outer closure member 21 contacting the sides 43 of saw tooth like projections 44 on the outside of the skirt 28 of the inner closure member 22. This serves to transmit application torque from the outer closure member 21 to the inner closure member 22. If the outer closure member 21 is lifted with respect to the inner closure member 22 such that the lugs 40, 41 on the inner and outer closure member do not interengage, application torque will still be transmitted from the outer closure member 21 to the inner closure member 22 via the saw tooth like projections 42, 44.

When rotating the outer closure member 21 in the removal direction and the lugs 36 and 40 on the inner and outer closure member are not engaged because the outer closure member 21 is moved axially upward with respect to the inner closure member 22 and continued removal torque is applied, abutments or saw tooth like projections 42, 44 on the inner and outer closure members will cam past each other, causing the skirt 26 of the outer closure member 21 to flex outwardly in the area of the projections 42, 44 as this camming takes place.

When the closure is fully applied the flexible projections 33 on the outer circumference of the indicator disk 31 are positioned in the pockets of the "U" shaped lugs 36 on the inner closure member; and the flexible fin like projections 34 on the inner circumference of the indicator disk 31 are in contact with the ribs 37 on the ring 38 projecting downward from the base wall 25 of the outer closure member 21. Rotating the closure in the unscrewing direction transmits torque from the ribs 37 to the indicator disk 31 via the flexible fins 34, to keep the indicator disk 31 stationary with respect to the outer closure member 21 and rotating in the counter clockwise direction with respect to the inner closure member 22. This rotation causes the flexible projections 33 on the outer circumference of the indicator disk 31 to move out of the "U" shaped pockets of the lugs 36 and continued rotation to the point where the lugs 37 on the base wall of the outer closure member 21 contact lugs 36 on the base wall of the inner closure member 22 causes a subsequent set of flexible projections 33 to locate in the "U" shaped pockets in the lugs on the inner closure member 22. Downward force and continued rotation will cause transmission of removal torque from the outer closure member 21 to the inner closure member 22 and the closure will be removed from the container.

When replacing the closure, it is rotated in the clockwise direction as it is screwed onto the container. Sufficient resistance to rotation is encountered as the closure is tightened to cause the inner closure member 22 to be relatively stationary with respect to the container finish and the indicator disk 31 is held stationary with respect to the inner closure member 22 by the flexible projections 33 on the outer circumference of the indicator disk locking into the "U" shaped projections 36 on the inner closure member 22. The outer closure member 21 is the only part rotating at this time and it rotates until the lugs 37 on the base wall contact the lugs 36 on the inner closure member 22; or the saw tooth projections 42 on the interior of its skirt of the outer closure member 21 contact saw tooth projections 44 on the skirt of the inner closure member 22; or both occur. Then application torque is transmitted from the outer closure member 21 to the inner closure member 22 via the lugs 36, 37 or saw tooth projections 42, 44, or both. This clockwise movement of the outer closure member 21 with respect to the inner closure member 22 and indicator disk 31 causes the window **32*a* in the outer closure member 21 to align itself from one position on the indicator disk 31 to the next succeeding position. Continued rotation of the outer closure member 21 in the clockwise direction causes the inner closure member 22 to be tightened further even if the outer closure member 21 is raised upward with respect to the inner closure member so that the lugs 36 on the inner closure member 22 and the lugs 40 on the and outer closure member 22 are not in contact with each other because of the engagement of the saw tooth projections 42, 44** on each closure member.

The lugs 36 on the inner closure member 22 and the lugs 40 on the outer closure member 21 are of such axial height and the indicator disk 31 is of such thickness such that axial movement of the outer closure member 21 with respect to the inner closure member will not cause either the flexible projections 33 on the outer circumference of the indicator disk 31 to lose contact with the "U" shaped lugs 36 or the flexible fin-like projections 34 on the inner circumference of the indicator disk 31 to lose contact with the ribs 37 on the ring 38 projecting downward from the outer closure member 21. While rotation of the outer closure member 21 can cause either of the inner or outer projections 33, 34 of the indicator disk 31 to lose contact with outer ribs 37 or inner "U" shaped lugs 36 there is always interference or potential interference in the axial direction with the projections 33, 34 on the indicator disk 31.

Rotational force, in either direction is always transmitted directly from the outer closure member 21 to the inner closure member 22. The indicator disk 31 is never used in the transmission of rotational force from the outer closure member 21 to the inner closure member 22.

It can be seen that lugs 36 perform a dual function of being operable both during the reminder function and child resistant function of the child resistant closure member.

It can thus be seen that there has been provided a child resistant reminder closure that only utilizes three parts; which utilizes the child resistant mechanism in the performance of the indexing function; which is resistant to indexing more than one position; and which can be readily modified to be non-child resistant.

Figure 17:
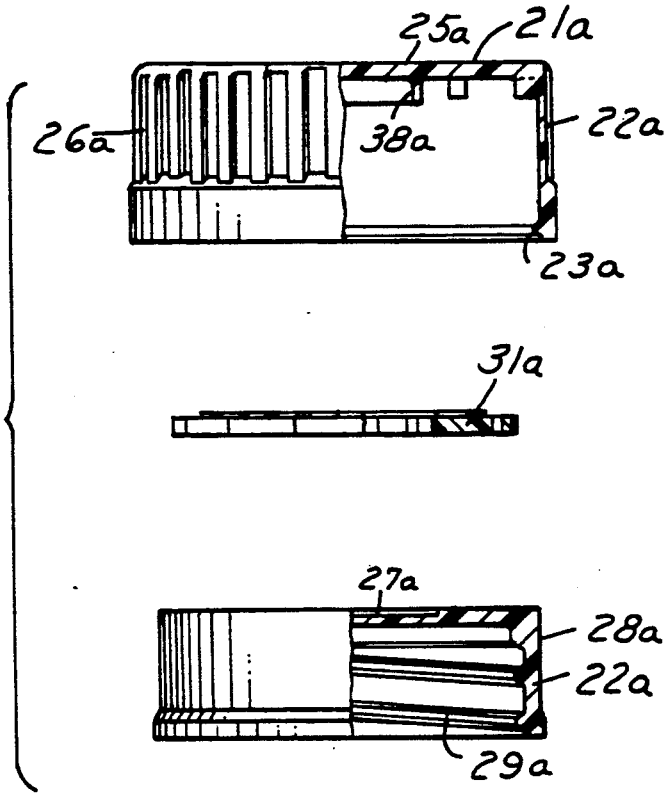
FIG. 17 is a part sectional view of the parts of the reminder closure shown in FIG. 16.
Figure 16:
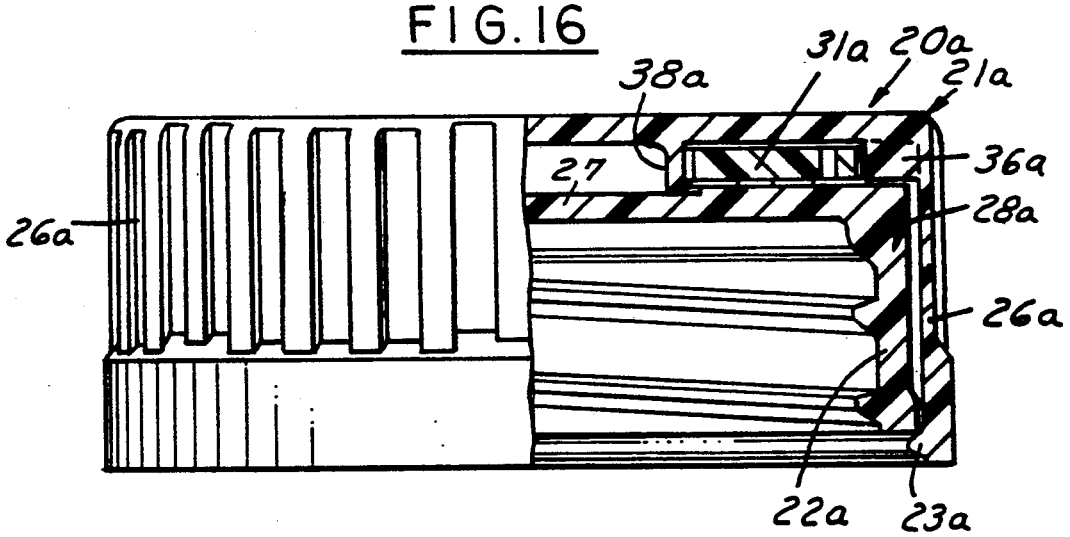
FIG. 16 is a part sectional view of a modified form of reminder closure which is not child resistant.

In the form of the invention shown in FIGS. 16 and 17, a modified form of reminder closure is provided wherein the child resistant function of the closure is eliminated. In this form the axial movement of the outer closure member **21*a* relative to the inner closure member 22*a* is eliminated by shortening the skirt 26*a* of the outer closure member 21*a* relative to the inner closure member 22*a*. In addition, the abutments or saw tooth projections 42 on the outer closure member 21*a* and the abutments or saw tooth projections 44 on the inner closure member 22*a* are eliminated. In this manner only the reminder function is retained. In this form, the indicator disk 31*a* is reversible so that the reminder disk 31*a*** can be selectively positioned to change the date either on removal or application of the reminder closure with respect to a container.

I claim:

1. A child resistant reminder closure comprising an outer closure member having a base wall and a peripheral skirt, an inner closure member having a base wall and a peripheral skirt, means on the outer closure member retaining the inner closure member against axial outward movement relative to the outer closure member, an indicator disk having an opening and being provided on the outer surface of the base wall of the inner closure member and being rotatable relative to the outer and inner closure members, said outer closure member having radial lugs on the undersurface of the base wall thereof, a first set of flexible radial ratcheting means extend radially inwardly into the opening from the indicator disk and engage said radial lugs on the undersurface of the base wall of the outer closure member, said inner closure member having circumferentially spaced lugs on the upper surface thereof, a second set of flexible radial ratcheting means extend radially from the indicator disk and engage said circumferentially spaced lugs on the upper surface of the inner closure member, interengaging means on the inner closure member adapted to engage means on a containers by relative rotation of said inner closure member and a container.

axially interengageable means on the outer closure member and the inner closure member which are interengaged to remove the closure or to apply the closure to a container thereby providing a child resistant function, inhibiting means between the outer closure member and the inner closure member operable to permit relative rotation between the outer closure member and the inner closure member upon rotation of the outer closure member in a direction to remove the closure from a container and operable to transmit force from the outer closure member to the inner closure member when the outer closure member is rotated in a direction to apply the closure to a container, said outer closure member, said inner closure member and said indicator disk being constructed and arranged to maintain engagement of the indicator disk with the outer closure member and the inner closure member, a window in the outer closure member, said indicator disk having indicia thereon visible through said window to indicate the circumferential position of said indicator disk relative to the outer closure member.

2. The child resistant reminder closure set forth in claim 1 wherein said second set of flexible radial ratcheting means on said indicator disk comprise flexible fingers extending circumferentially in one direction and having free ends, said first set of flexible radial ratcheting means comprising a plurality of circumferentially extending flexible fingers extending in the same direction as the second set of fingers and positioned on said opening in said indicator disk.

3. The child resistant reminder closure set forth in claim 2 wherein said lugs on said outer closure member are provided on the periphery of a cylindrical surface extending downwardly from the base wall of said outer closure member.

4. The child resistant reminder closure set forth in claim 2 wherein each said lug on said inner closure member has an axial recess for engagement with one of said second set of flexible fingers.

5. The child resistant reminder closure set forth in claim 3 wherein said lugs on said inner closure member have recesses engageable by said second set of fingers.

6. The child resistant reminder closure set forth in claim 1 wherein said axially interengageable means providing the child resistant function comprise lugs on the inner closure member extending toward said base wall of said outer closure member and having recesses therein engaging lugs on the outer closure member.

7. The child resistant closure set forth in claim 1 wherein said inhibiting means comprise interengageable saw tooth projections on the inner surface of the skirt of the outer closure member and on the outer surface of the skirt of the inner closure member.

8. A reminder closure comprising an outer closure member having a base wall and a peripheral skirt, an inner closure member having a base wall and a peripheral skirt, means on the outer closure member retaining the inner closure member against axial outward movement relative to the outer closure member, an indicator disk having an opening and being provided on the outer surface of the base wall of the inner closure member and being rotatable relative to the outer and inner closure members, said outer closure member having radial lugs on the undersurface of the base wall thereof, a first set of flexible radial ratcheting means extend radially inwardly into the opening from the indicator disk and engage said radial lugs on the undersurface of the base wall of the outer closure member, said inner closure member having circumferentially spaced lugs on the upper surface thereof, a second set of flexible radial ratcheting means extend radially from the indicator disk and engage said circumferentially spaced lugs on the upper surface of the inner closure member, interengageable means on the outer closure member and the inner closure member which are interengaged by relative rotation between the outer closure member and the inner closure member toremove the closure or to apply the closure to a container, a window in the outer closure member, said indicator disk having indicia thereon visible through said window to indicate the circumferential position of said indicator disk relative to the outer closure member.

9. The reminder closure set forth in claim 8 wherein said second set of flexible radial ratcheting means on said indicator disk comprise flexible fingers extending circumferentially in one direction and having free ends, said first set of flexible radial ratcheting means comprising a plurality of circumferentially extending flexible fingers extending in the same direction as the second set of fingers and positioned on said opening in said indicator disk.

10. The reminder closure set forth in claim 9 wherein said lugs on said outer closure member are provided on the periphery of a cylindrical surface extending downwardly from the base wall of said outer closure member.

11. The reminder closure set forth in claim 10 wherein each said lug on said inner closure member has an axial recess for engagement with one of said second set of flexible fingers.

12. The reminder closure set forth in claim 10 wherein said lugs on said inner closure member have recesses engageable by said second set of fingers.

* * * * *

UNITED STATES PATENT AND TRADEMARK OFFICE

CERTIFICATE OF CORRECTION

PATENT NO. : 5,188,251

DATED : Feb. 23, 1993

INVENTOR(S) : Maximillian Kusz

It is certified that error appears in the above-indentified patent and that said Letters Patent is hereby corrected as shown below:

In the drawings, Fig. 17, should be deleted to appear as per attached sheet.

Signed and Sealed this

Twenty-second Day of March, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,188,251

DATED : Feb. 23, 1993

INVENTOR(S) : Maximillian Kusz

It is certified that error appears in the above-identified patent and that said Letters Patent is hereby corrected as shown below:

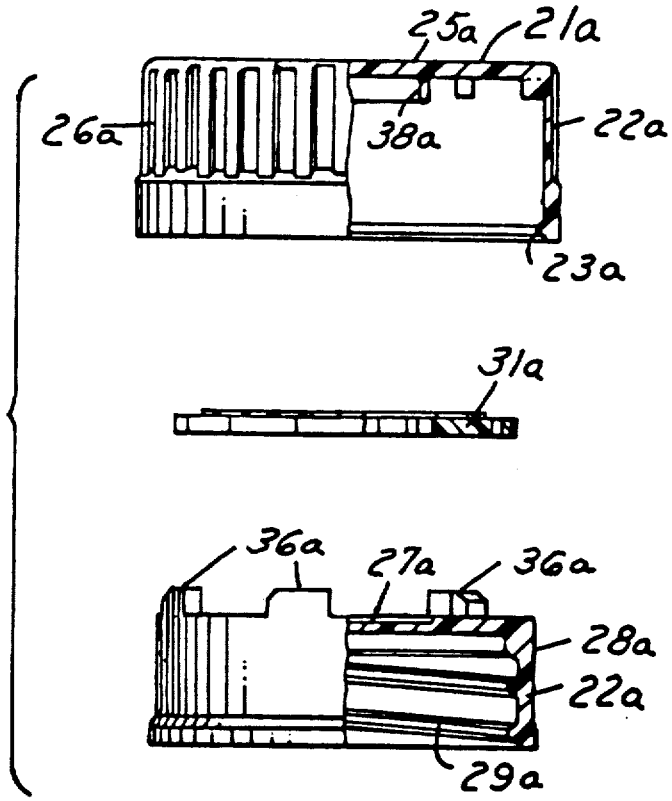

FIG. 17